United States Patent [19]

Phelps

[11] Patent Number: 4,526,369

[45] Date of Patent: Jul. 2, 1985

[54] GOLF AID

[76] Inventor: Paul E. Phelps, 5 Bronson Ave., Searsdale, N.Y. 10583

[21] Appl. No.: 483,294

[22] Filed: Apr. 8, 1983

[51] Int. Cl.[3] ..... A63B 57/00

[52] U.S. Cl. ..... 273/32 B; 273/32.5

[58] Field of Search ..... 273/33, 32.5, 162 E, 273/162 D, 32 B, 32 F; 294/19.2, 23; 135/80, 81, 78; 248/155.3, 156, 216.1, 218.3, 221.3, 222.1, DIG. 11, DIG. 12

[56] References Cited

U.S. PATENT DOCUMENTS

| | | | |
|---|---|---|---|
| 57,416 | 8/1866 | Ware | 135/81 |
| 1,298,721 | 4/1919 | Hughes | 135/81 |
| 1,580,295 | 4/1926 | Glowacki | 135/81 |
| 1,830,520 | 11/1931 | Moyses | 273/162 E |
| 2,044,838 | 6/1936 | Douglas | 273/162 E |
| 2,154,989 | 4/1939 | Moore | 294/19.2 |
| 2,609,198 | 9/1952 | Armstrong | 273/32.6 |
| 2,720,249 | 10/1955 | Peterson | 248/156 |
| 3,904,200 | 9/1975 | Jackle | 273/32.5 |
| 4,013,295 | 3/1977 | Baughman | 273/32.5 |
| 4,313,604 | 2/1982 | Baxter | 273/32.5 |
| 4,364,405 | 12/1982 | Norwood et al. | 135/81 |
| 4,411,284 | 10/1983 | Opitz | 135/81 |

*Primary Examiner*—Richard C. Pinkham
*Assistant Examiner*—T. Brown
*Attorney, Agent, or Firm*—Blodgett & Blodgett

[57] ABSTRACT

Golf aid for setting a golf ball and tee in driving position and for retrieving a golf ball and golf tee. An elongated shaft, a housing at one end of the shaft having a ball seat and a tee supporting finger pivotally mounted on the housing for holding the head of a tee against the golf ball and urging the golf ball against the valve seat. An annular cup-shape elastomeric ball retriever is attached to the opposite end of the shaft, the retriever having an annular outer edge which defines a circular opening for receiving a golf ball, the edge having a notch for receiving a tee.

17 Claims, 13 Drawing Figures

Fig.1
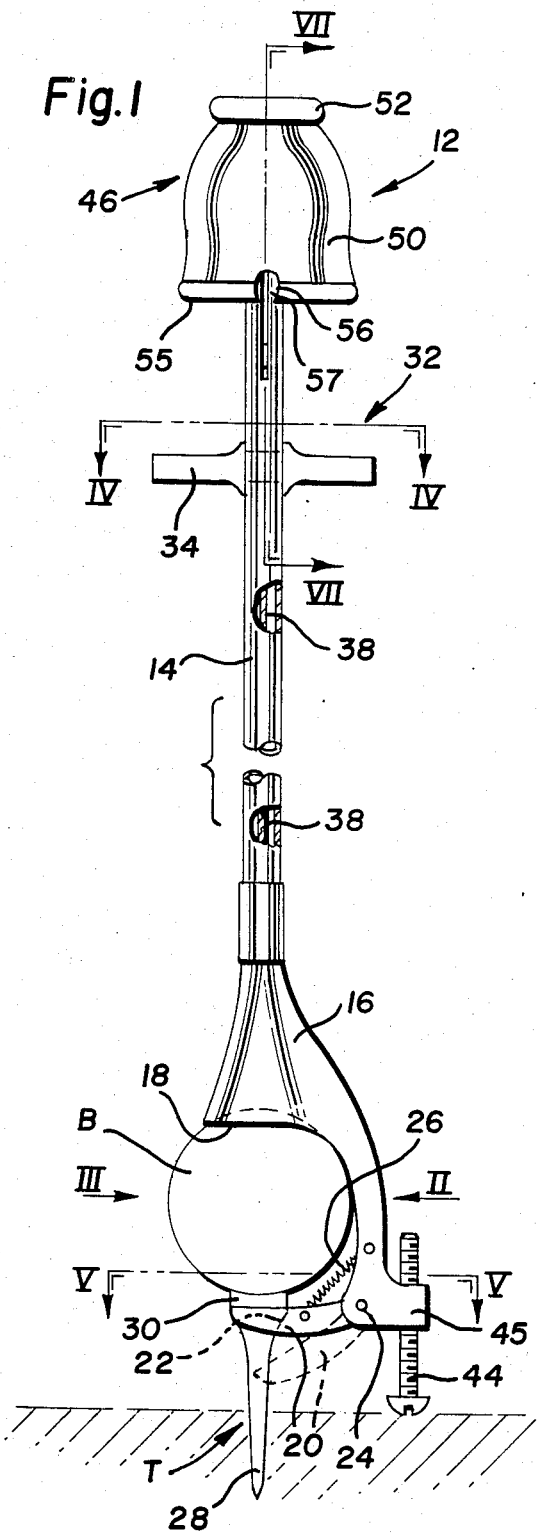
Fig.2
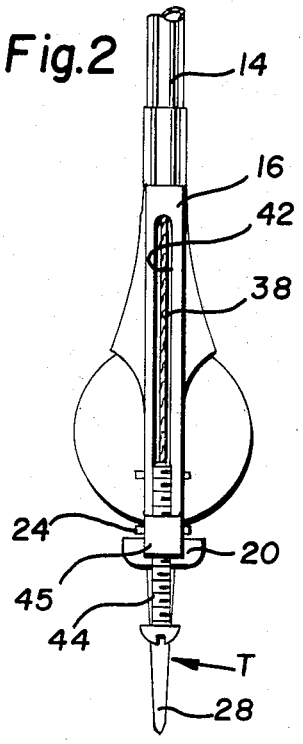
Fig.3
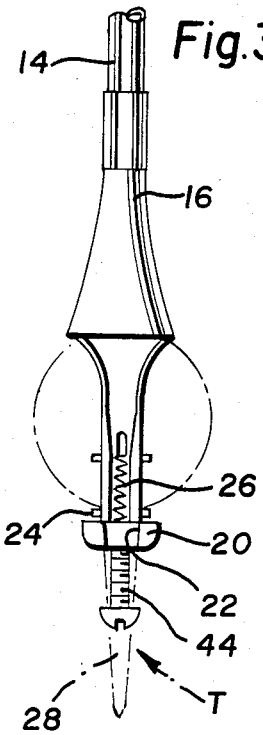
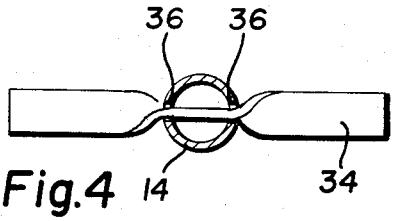
Fig.4
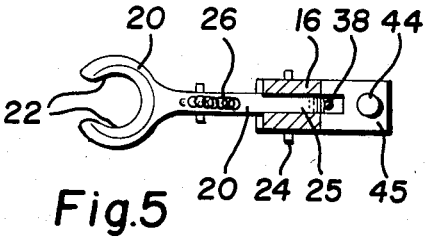
Fig.5

GOLF AID

BACKGROUND OF THE INVENTION

This invention relates generally to a golf accessory and more particularly to a golf aid for placing a tee and golf ball in teed driving position, for picking up the tee and for removing the ball from the cup.

At the beginning of play for each hole, the golfer "tees up" by planting the tee into the ground at a designated teeing area and placing the ball on the tee. After the ball is driven, the tee is picked up. The ball is not ordinarily touched again until it lands in the cup. At this point, the golfer picks up the ball from the cup and proceeds to the next hole. For most people, the stooping and bending which is involved in teeing up and removing the ball from the cup presents no difficulty. However, for certain individuals, such as convalescents, elderly people or those who have certain physical handicaps, this part of the game can present considerable difficulty and may represent the only serious limitation for the individual in playing golf.

Golf aids have been developed for assisting the golfer in teeing up the ball. One such golf aid comprises a clamping element at the end of an elongated shaft. The clamping element holds the ball and tee together by the application of pressure from the upper portion of the shaft. The pressure on the ball and tee is maintained while pushing downwardly on the shaft and planting the tee into the ground. Thereafter, the golf aid is removed from the tee and ball and the ball is left supported on the tee in position to be driven. A major disadvantage with this type of golf aid is that the pressure on the ball and tee must be physically maintained throughout the operation of teeing up the ball which normally requires the use of both hands in performing this operation. Although the golf aid allows the golfer to tee up the ball without bending, the entire teeing operation is time consuming and tedious. The golfer must remove the golf aid from the golf bag and walk to the teeing area to tee up the ball. Then the golfer must bring the golf aid to the golf bag and remove the club which is to be used for driving.

Other disadvantages of prior art golf aids is that there is no provision for picking up the tee after the ball has been driven or removing the ball from the cup. These and other difficulties experienced with the prior art devices have been obviated by the present invention.

It is, therefore, an outstanding object of the invention to provide a golf aid which normally holds and clamps a golf tee and golf ball together and enables the golfer to tee up the golf ball with one hand from an upright position.

Another object of the invention is the provision of a golf aid which allows teeing up of the ball and picking up the ball from the cup both from an upright position.

A further object of the invention is the provision of a golf aid which enables a golfer to tee up a golf ball from an upright position in which can be anchored in an upright position on the ground when it is not being used.

It is another object of the invention to provide a golf aid which allows teeing up of the golf ball from an upright position which allows picking up of the tee from an upright position after the ball is driven.

It is a further object of the invention to provide a golf aid which is capable of picking up a golf ball on the ground or in a cup and a tee which is in a prone position on the ground.

A still further object of the invention is the provision of a golf aid which is simple in construction and easy to operate and is capable of a long life of useful service.

With these and other objects in view, as will be apparent to those skilled in the art, the invention resides in the combination of parts set forth in the specification and covered by the claims appended hereto.

SUMMARY OF THE INVENTION

A golf aid for setting a golf ball and tee in driving position on the ground comprising an elongated shaft, a clamping mechanism at the bottom end of the shaft for holding a golf tee and golf ball so that the golf ball rests on the head of the tee with the shaft of the tee extending downwardly, the clamping mechanism having a fixed member and a movable member. The movable member is biased toward the fixed member for clamping the golf ball and tee between the movable member and the fixed member so that the tee can be planted in the ground, the ball supported on the tee in driving position by pushing the shaft downwardly. The movable member is moved away from the fixed member by actuating means to release the golf aid from the golf ball and tee which have been set in driving position. More specifically, the golf aid is provided with an elastomatic cup which is capable of picking up a golf ball and a tee, a stake for anchoring the golf aid in the ground in an upright position, and an adjustable gage for determining the distance at which the tee is planted into the ground.

BRIEF DESCRIPTION OF THE DRAWINGS

The character of the invention, however, may be best understood by reference to one of its structural forms, as illustrated by the accompanying drawings, in which:

FIG. 1 is a side elevational view of the golf aid embodying the principles of the present invention, FIG. 2 is a rear elevational view of the golf aid looking in the direction of arrow II of FIG. 1, FIG. 3 is a front elevational view of a golf aid looking in the direction of arrow III of FIG. 1, FIG. 4 is a horizontal cross-sectional view taken on the line IV—IV of FIG. 1, FIG. 5 is a horizontal cross-sectional view taken on the line V—V of FIG. 1.

DESCRIPTION OF THE PREFERRED EMBODIMENT

Figure 6:
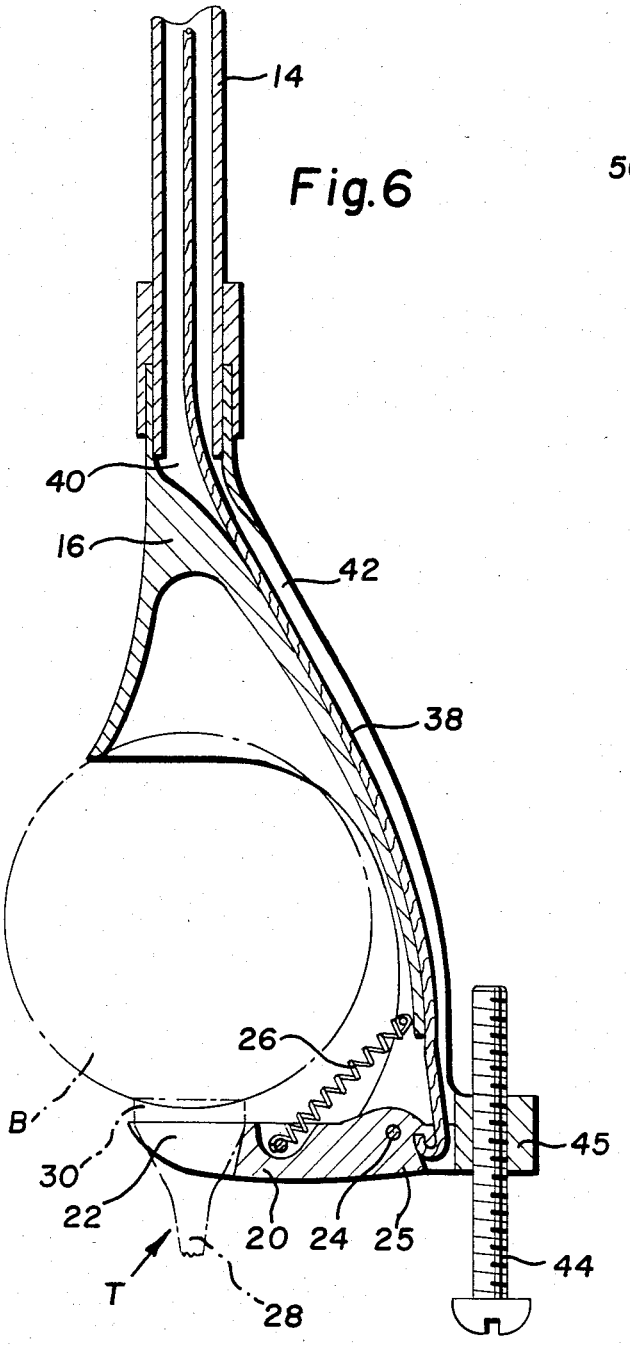
FIG. 6 is a vertical cross-sectional view taken on the line VI—VI of FIG. 3 on an enlarged scale.

Referring first to FIGS. 1–4, the golf aid in the present invention is generally indicated by the reference numeral 12 and is shown holding a golf ball B and the golf tee T in a teeing position relative to the ground G. The tee has a head portion 30 and a shank portion 28.

The golf aid 12 comprises an elongated tubular shaft 14 and a housing 16 which is fixed to the bottom of the shaft and which includes a generally concave ball seat 18. A tee supporting finger 20 is pivotally mounted at the lower end of the housing 16 by means of a pin 24. The forward end of the finger 12 has a circular slot 22. The upper periphery of the slot 22 is generally concave and defines a seat for the head portion 30 of the tee. A tension spring 26 is attached to the finger 20 and to the housing 16 and urges the finger 20 toward the ball seat 18. A portion of the finger 20 extends rearwardly of the pivot pin 24 so that the finger functions as a bell crank lever. The rearwardly extending portion of the finger 20, indicated by the reference numeral 25, is attached to one end of a cable 38. The opposite end of a cable 38 is attached to a handle 34 which forms part of an actuating means, generally indicated by the reference numeral 32. The handle 34 is slidably mounted within a pair of opposed vertical slots 36 in the wall of the tubular shaft 14. The handle 34 extends laterally in opposite directions from the shaft 14 so that it can be easily grasped by the golfer.

The upper end of the cable 38 is attached to the portion of the handle 34 which lies within the tubular 14 and extends downwardly to an opening 40 at the upper end of the housing 16 which communicates with the interior of the shaft 14. The cable 38 is guided along a curved groove 42 at the rear portion of the housing 16 and is anchored into the rearwardly extending portion 25 of the finger 20. A screw 44 is threaded through a rearwardly extending flange 45 of the housing 16. The position of the screw 44 relative to the flange 45 is adjusted by turning the screw. In this way, the length of the portion of the screw which extends below the flange 45 can be varied so that the screw functions as a depth gage for the penetration of the tee in the ground, (see particularly FIG. 1).

Figure 7:
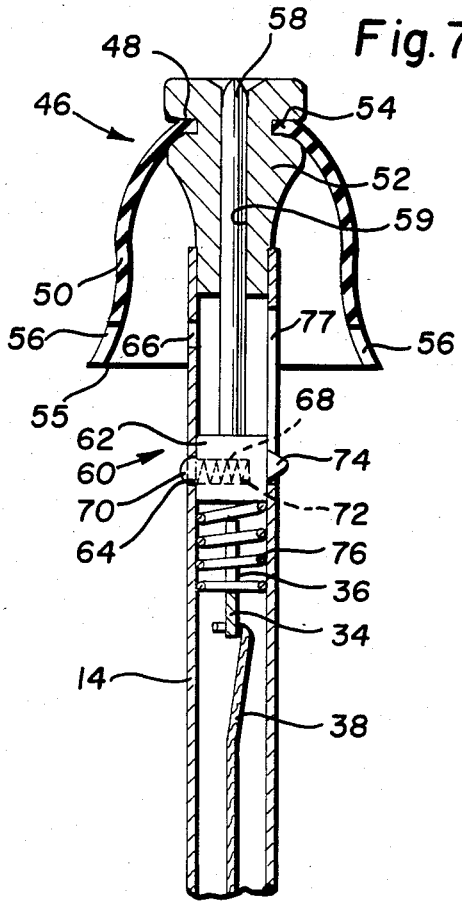
FIG. 7 is a fragmentary horizontal cross-sectional view taken on the line VII—VII of FIG. 1.
Figure 8:
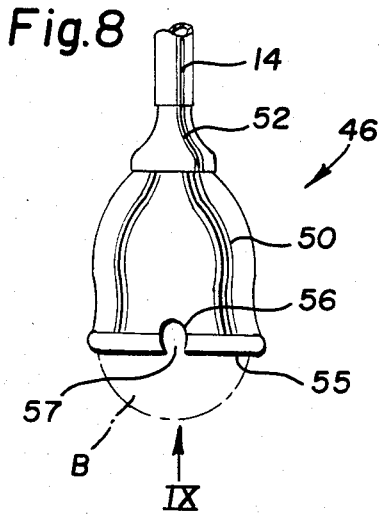
FIG. 8 is a fragmentary view of the ball retrieving portion of the golf aid shown in an operative position for retrieving a golf ball.
Figure 9:
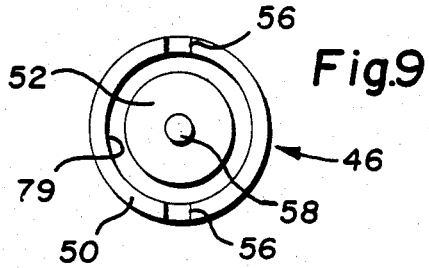
FIG. 9 is a plan view looking in the direction of arrow IX of FIG. 8.
Figure 12:
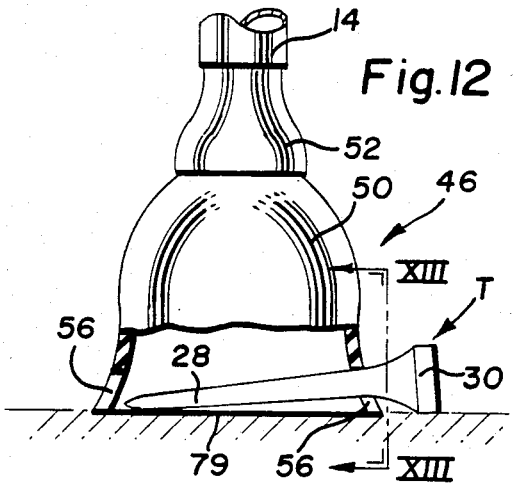
FIG. 12 is a fragmentary view of the golf aid shown in an operative position for retrieving a tee which is in a prone position on the ground.
Figure 13:
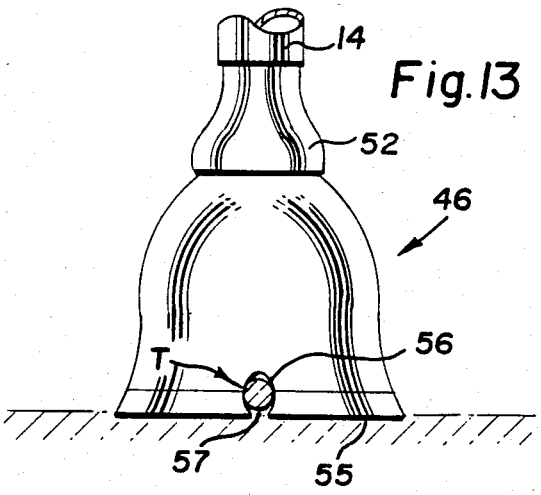
FIG. 13 is a vertical sectional view taken on the line XIII—XIII of FIG. 12.

Referring to FIGS. 1, 7, and 8, the golf aid 12 is also provided with a ball retriever generally indicated by the reference numeral 46 which comprises an elastomeric cup-shaped element having a base portion 48 and an annular wall portion 50. The base portion 48 consists of an annular wall portion 50. The base portion 48 consists of an annular inwardly-extending flange which defines a large central opening. The flange portion of the base 48 is anchored in an annular groove 54 in a holder 52 which is fixed to the shaft 14 and forms an upper extension of the shaft. The outer annular edge of the wall 50, indicated by the reference numeral 55 is provided with a pair of slots 56. Each of the slots 56 is used for retrieving a golf tee as shown in FIGS. 12 and 13.

The opening of each slot 56, indicated by the reference numeral 57, is narrower than at least a portion of the tee which is to be retrieved. Preferably the interior portion of the slot is a little wider than the opening 57. The wall 50 is sufficiently flexible so that it can be completely inverted from a non-operative position, as shown in FIGS. 1 and 7, to an operative position, shown in FIG. 8.

Figure 10:
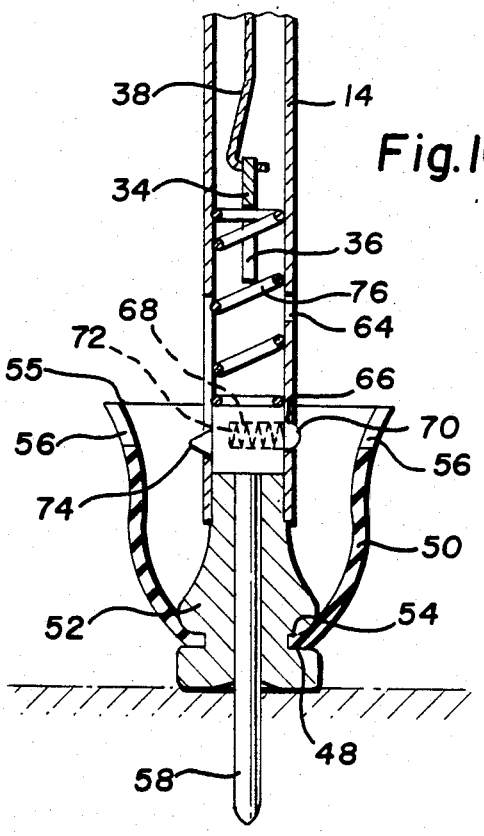
FIG. 10 is a fragmentary cross-sectional view showing the anchoring pin in the fully extended or operative position.

Referring particularly to FIGS. 7 and 10, the golf aid is provided with an anchoring pin slidably mounted for axial movement within an aperture 59 in the holder 52. A pin 58 is moved axially by actuating means, generally indicated at 60. The actuating means 60 comprises a cylindrical sliding block 62 slidably mounted within the tubular shaft 14 and which is fixed to the inner end of the pin 58. The block 62 has a lateral cylindrical opening 68 for receiving a ball detent 70. The ball detent 70 is removable from an inner position in which it lies entirely within the opening 68 to an outer position in which it protrudes beyond the outer surface of the block 62 as shown in FIG. 7. A spring 72 is located within the opening 68 to maintain the wall detent 70 in its outer position. The shaft 14 is provided with a lower aperture 64 and an upper aperture 66 which are adapted to latchingly receive the ball detent 70. The upper end of the shaft 14 is also provided with a vertical slot 77 which is diametrically opposed to the apertures 64 and 66. The block 62 is provided with a button 74 which is diametrically opposed from the ball detent 70 and which extends through the slot 77. The button 74 is adapted to be engaged by the finger of the operator and is guided vertically in the slot 77 so that the ball detent 70 is maintained in vertical alignment with the apertures 64 and 66. When the pin 58 is in the retracted position, as shown in FIG. 7, the ball detent 70 extends into the aperture 64 and functions to latch the anchoring pin 58 in the retracted position. When the anchoring pin is in the extended or operative position as shown in FIG. 10, the ball detent 70 extends into the aperture 66 and thereby functions to latch the anchoring pin 58 in the extended or operative position. The anchoring pin 58 is moved from one position to the other by depressing the ball detent 70 and pushing the button 74 along the slot 77 until the ball detent 70 snaps into one of the apertures 64 or 66. The anchoring pin 58 is normally urged to the extended or operative position by the spring 76 which bears against the sliding block 62. The spring 76 also urges the handle 34 toward the housing 16 in its non-operative position.

The operation and advantages of the present invention will now be readily understood in view of the above description. The golf aid 12 is normally carried as an extra club in the golfers golf bag. At the beginning of play, the golfer removes the golf aid 12 from the bag and places a tee in the slot 22 of the finger 20 so that the head 30 of the tee extends above the finger (as shown in FIG. 1). The golfer then places the ball B on top of the head of the tee so that the upper portion of the ball seats into the ball seat 18 (as shown in FIG. 1). The screw 44 is adjusted to limit the amount of penetration of the shank portion 28 of the tee. Once that the golfer has arrived at a particular setting of the screw 44, the tee will always extend above the ground at the same height regardless of the length of the tee. This enables the ball to be consistently positioned at the same height relative to the ground for each hole.

After the tee and ball have been positioned in the golf aid (as shown in FIG. 1), the golfer holds the golf aid 12 so that the shaft 14 extends vertically and the tee is positioned at the proper location in the teeing area. The golfer then pushes downwardly on the holder 52 to plant the shank portion 28 into the ground until the end of the screw 44 touches the ground. The operator then places his first two fingers beneath the extending portions of the handle 34 and the thumb or palm of the same hand on top of the holder 52. By drawing the fingers toward the thumb or palm, the handle 34 is lifted upwardly. The upward motion of the handle 34 causes the cable 38 to pull upwardly on the rearwardly extending portion 25 of the finger 20, thereby causing the forwardly extending portion of the lever 20 to move downwardly to the dotted line position (shown in FIG. 1). This causes the slot 22 to swing away from the head of the tee and to remove the clamping pressure of the finger 20 against the tee. Using the head of the screw 44 as a fulcrum, the golf aid 12 is swung away from the golf ball and tee so that the golf aid 12 can be easily removed from the tee and golf ball without knocking the ball off the tee. This leaves the golf ball in the proper teeing position on the golf tee and the ball is now in readiness to be driven by a golf club.

Figure 11:
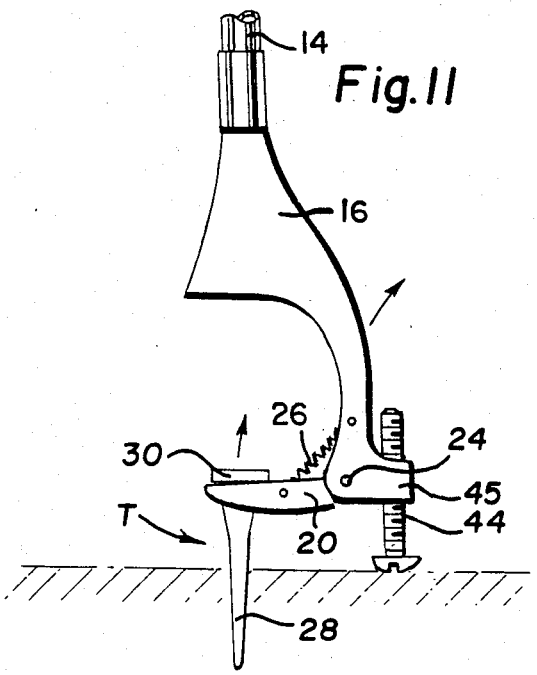
FIG. 11 is a fragmentary view of the golf aid shown in an operative position for retrieving a tee which is in a teed position.

After the golf ball has been driven, there are two things that can happen to the tee. If the golf club strikes the upper portion of the ball, the tee may remain in the driving position. In this case, the golfer holds the golf aid 12 so that the finger 20 is re-applied to the golf tee and the golf tee enters the slot 22. The golf aid 12 is then pulled upwardly so that the finger 20 pulls the tee out of the ground (as shown in FIG. 11).

If the lower portion of the golf ball is struck, the tee will be pulled out of the ground by the golf club and will lay in a prone position on the ground. In this case, the retriever 46 is inverted from the non-operative position shown in FIG. 1 to the operative position shown in FIGS. 12 and 13. The golf aid 12 is inverted so that the retriever 46 extends downwardly. When the retriever 46 is in the operative position (as shown in FIGS. 12 and 13), the annular edge 55 defines an opening 79. One of the slots 56 is positioned over the shank portion 28 of the tee and downward pressure is applied to the golf aid 12 to force the opening 57 of the slot 56 over the tee. Upon release of downward pressure on the golf aid, the tee will be firmly held in the slot 56. The tee is then lifted up from the ground by the golfer. The golf aid 12 is then placed in the golfers bag and play is resumed in normal fashion. The tee can be picked up by simply positioning the ball retriever 46 over the tee and rolling the edge 55 over the tee with sufficient pressure so that the tee snaps into the slot 56.

When the ball is placed in the cup at the end of play on the green, the golf aid 12 is utilized to remove the ball from the cup. This is accomplished by inverting the retriever 46 to the operative position, if it is not already in that position, and inserting the retriever 46 into the cup over the golf ball. The golfer then pushes downwardly on the holder 52 so that the opening 79 is moved downwardly over the golf ball. The ball is thereby forced within the interior space defined by the annular angular wall 50. The diameter of this interior space is less than the diameter of the golf ball so that the annular wall 50 is slightly stretched around the golf ball and functions to hold the golf ball tightly. The golfer then lifts the retriever 46 and the golf ball to a level where the ball is easily removed from the retriever by the golfer. The golfer is now ready to play the next hole.

Referring particularly to FIGS. 1, 7, and 10, the golf aid 12 can be held in an upright position when not in use by means of the anchoring pin 58. The anchoring pin 58 is normally held in the retracted position, as shown in FIG. 7, when the golf aid is used for ball and tee retrieving and for setting the tee and ball in the driving position. The anchoring pin 58 is used at the beginning of play and at the end of play of a particular hole. At the beginning of play and after the ball has been teed up, the anchoring pin 58 is moved from the retracted position, as shown in FIG. 7, to the extended or operative position as shown in FIG. 10. The golf aid 12 is inverted so that the anchoring pin 58 extends downwardly and the shaft 14 is pushed downwardly to drive the pin 58 into the ground as shown in FIG. 10. The golfer then drives the ball from the tee and places the driving club in his bag. The golfer then grasps the golf aid which is being held in the upright position on the ground and pulls the pin 58 out of the ground. The pin 58 is then retracted to a position shown in FIG. 7 and the golf aid 12 is then used to retrieve the tee in the manner described above. Near the end of play of the hole when the ball has been placed on the green, the golfer removes the golf aid 12 and the putter from the golf bag which according to the rules and etiquette of golf must be left in a position off the green. The golfer then advances to his ball on the green and plants the anchoring pin 58 into the ground to support the golf aid in an upright position on the green. The golfer is then free to use his putter to putt the ball in the hole. The ball is then retrieved in the manner described above and the golfer is now ready to play the next hole.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been described, what is claimed as new and desired to secure by Letters Patent is:

1. Golf aid for setting a golf ball and a tee in driving position on the ground, wherein the tee consists of a relatively narrow shank portion for insertion into the ground and a relatively enlarged head portion for supporting the golf ball, the golf aid comprising:

(a) a housing having a downwardly facing concave ball seat and having a lower portion which extends below said ball seat, (b) an elongated shaft extending upwardly from the housing, (c) a tee supporting finger located below and spaced from said ball seat, said finger having an open ended slot which is wide enough to receive the shank portion of the tee and which is narrower than the head portion of the tee for supporting the tee in the upright position, said finger being pivotally mounted on the housing at a fixed point on the lower portion of the housing so that the slot is swingable toward and away from said ball seat, (d) biasing means for urging said finger upwardly toward said ball seat so that the head portion of a tee which is placed in the upright position in said slot is urged against a ball which is placed in said ball seat, whereby said shank portion can be pushed into the ground by applying a downward force on the shaft, and (e) actuating means for moving said finger away from said ball seat and away from its supporting relationship with the tee so that the golf aid can be removed from the ball and tee.

2. Golf aid as recited in claim 1, wherein said slot is circular and the upper surface of said finger which is immediately adjacent the slot is concave and defines a seat for the head portion of the tee.

3. Golf aid as recited in claim 1, wherein said biasing means is a tension spring which is connected at one end to the finger and at its opposite end to the housing.

4. Golf aid for setting a golf ball and a tee in driving position on the ground, wherein the tee is comprised of a relatively narrow shank portion for insertion into the ground and a relatively enlarged head portion for supporting the golf ball, the golf aid comprising:

(a) a housing having a downwardly facing concave ball seat, (b) an elongated shaft extending upwardly from the housing, (c) a tee supporting finger located below and spaced from said ball seat, said finger having an open ended slot which is wide enough to receive the shank portion of the tee and narrower than the head portion of the tee for supporting the tee in the upright position, said finger being pivotally mounted on the housing so that the slot is swingable toward and away from said ball seat, (d) biasing means for urging said finger toward said ball seat so that the head portion of a tee which is placed in the upright position in said slot is urged against a ball which is placed in said ball seat, whereby said shank portion can be pushed into the ground by applying a downward force on the shaft, (e) a cable which is operatively connected at one end to the finger and, (f) a hand actuated movable handle operatively connected to the opposite end of the cable, said handle being mounted on the upper end of the elongated shaft for movement relative to the shaft between a non-operative position and an operative position, said handle being effective when moved to the operative position for moving said finger away from said ball seat and away from its supporting relationship with the tee so that the golf aid can be removed from the ball and the tee.

5. Golf aid as recited in claim 4, wherein said finger forms one arm of a bell crank lever, the other arm of said lever being connected to the cable.

6. Golf aid as recited in claim 4, comprising a depth gage which is mounted on the housing and which extends below the finger for limiting the penetration of the tee into the ground.

7. Golf aid as recited in claim 6, wherein the depth gage is adjustably mounted on the housing for changing the distance that the gage extends below the finger.

8. Golf aid as recited in claim 4, wherein an elastomeric cup-shaped golf ball retriever is attached to the upper end of the shaft.

9. Golf aid as recited in claim 8, wherein the ball retriever comprises:

(a) a base portion which is attached to the upper end of the shaft, and (b) an annular wall portion which extends upwardly from the portion to an annular edge which defines a circular top opening for receiving a golf ball, said opening having a diameter which is less than the diameter of a golf ball and said wall being sufficiently elastomeric to be stretched by the golf ball when the golf aid is inverted and the retriever is forced against the ball for holding the golf ball.

10. Golf aid as recited in claim 1, wherein said wall is capable of being inverted relative to the base so that the wall extends downwardly over the top of the shaft in a non-retrieving position.

11. Golf aid as recited in claim 9, wherein said wall has a slot which extends from said annular edge toward said base at least portion of said slot being narrower than at least a portion of a golf tee so that when said slot is positioned over said golf tee portion of a prone golf tee and the shaft is pushed toward the tee, the tee is forced into the slot and held.

12. Golf aid as recited in claim 4, wherein an elongated anchoring pin is mounted at the upper end of the shaft and extends above the top of the shaft, said anchoring pin being adapted to penetrate the ground for supporting the golf aid in the inverted position relative to the ground.

13. Golf aid as recited in claim 12, wherein said anchoring pin is mounted at the upper end of the shaft so that the pin is retractable to a non-operative position within the shaft.

14. Golf aid as recited in claim 4 comprising:

(a) an elongated anchoring pin mounted for axial movement within the upper end of the shaft from a retracted position in which the pin lies entirely within the shaft to an operative position in which a substantial portion of the pin extends above the top of the shaft, and said anchoring pin being adapted to penetrate the ground for supporting the golf aid in the inverted position relative to the ground, and (b) actuating means for selectively positioning said pin in either of said operative and retracted positions.

15. Golf aid as recited in claim 14, wherein latching means are provided for selectively latching said pin in either of said operative and retracted positions.

16. Golf aid as recited in claim 15, comprising biasing means for biasing said pin toward said operative position.

17. Golf aid for setting a golf ball and tee in driving position on the ground, comprising:

(a) an elongated shaft having a bottom end and a top end, (b) a housing which is attached to the bottom end of the shaft, said housing having a ball seat and a lower portion which extends below said ball seat, (c) a tee supporting finger for releasably holding the tee in an upright position, said finger being below and spaced from said ball seat and being pivotally mounted at a fixed point on the lower portion of the housing for movement toward and away from said ball seat, and (d) actuating means for selectively moving the finger upwardly toward and away from said ball seat so that urging of said finger toward said ball seat by said actuating means causes a golf ball which is placed between the ball seat and a tee which is supported by the finger to be clamped between the ball seat and the tee and urging of said finger by said actuating means away from said ball seat releases the ball from being clamped against the ball seat, whereby the tee can be planted into the ground in a ball supporting position by applying a downward force on the shaft when the ball is clamped, and the golf aid can be removed from the planted tee and ball when the ball is released from clamping.

* * * * *